US008801821B2

(12) United States Patent
Hershbarger et al.

(10) Patent No.: US 8,801,821 B2
(45) Date of Patent: Aug. 12, 2014

(54) EXHAUST GAS AFTER-TREATMENT DEVICE WITH PRESSURIZED SHIELDING

(75) Inventors: James M. Hershbarger, LeClaire, IA (US); James P. Batzold, Davenport, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 13/219,642

(22) Filed: Aug. 27, 2011

(65) Prior Publication Data

US 2013/0047564 A1 Feb. 28, 2013

(51) Int. Cl.

| | |
|---|---|
| ***B01D 46/00*** | (2006.01) |
| ***F01N 3/023*** | (2006.01) |
| ***F01N 3/028*** | (2006.01) |

(52) U.S. Cl.

USPC ..... 55/385.3; 55/DIG. 30; 60/311

(58) Field of Classification Search

USPC ..... 55/385.3, DIG. 30, 523, 283, 288, 289, 55/302; 60/311; 95/279, 280

See application file for complete search history.

(56) References Cited

U.S. PATENT DOCUMENTS

| | | | | |
|---|---|---|---|---|
| 4,744,217 | A * | 5/1988 | Goerlich et al. | 60/303 |
| 5,158,753 | A * | 10/1992 | Take et al. | 422/173 |
| 5,194,078 | A * | 3/1993 | Yonemura et al. | 55/466 |
| 6,464,744 | B2 * | 10/2002 | Cutler et al. | 55/482 |
| 6,767,378 | B2 * | 7/2004 | Nishiyama et al. | 55/309 |
| 6,800,108 | B2 * | 10/2004 | Noda | 55/523 |
| 7,279,022 | B2 * | 10/2007 | Johnson | 55/399 |
| 7,410,521 | B2 * | 8/2008 | Sellers et al. | 55/523 |
| 7,442,218 | B2 * | 10/2008 | Okubo et al. | 55/282.3 |
| 7,721,536 | B2 * | 5/2010 | Bradley et al. | 60/295 |
| 7,935,163 | B2 * | 5/2011 | Samaras et al. | 55/385.3 |
| 8,142,552 | B2 * | 3/2012 | Meister et al. | 95/278 |
| 2010/0111779 | A1 | 5/2010 | Redmann et al. | |

FOREIGN PATENT DOCUMENTS

| | | |
|---|---|---|
| DE | 20318332 U1 | 2/2004 |
| DE | 102005044494 B3 | 3/2007 |

* cited by examiner

*Primary Examiner* — Duane Smith
*Assistant Examiner* — Minh-Chau Pham

(57) ABSTRACT

An exhaust gas after-treatment device has a body containing an after-treatment element and a shield that substantially encloses the outer surface of the after-treatment device. The shield is coupled to the exhaust gas outlet of the after-treatment device such that at least a portion of the exhaust gas exiting the after-treatment device is conducted into the space between the outer surface of the after-treatment device and the shield.

11 Claims, 1 Drawing Sheet

EXHAUST GAS AFTER-TREATMENT DEVICE WITH PRESSURIZED SHIELDING

FIELD OF THE INVENTION

The present invention relates to after-treatment devices for internal combustion engines. More particularly it relates to devices for keeping after-treatment devices clean. Even more particularly, it relates to pressurized shielding for after-treatment devices.

BACKGROUND OF THE INVENTION

Agricultural equipment operates in dusty, dirty environments full of light fluffy dry crop material. This equipment is traditionally powered with internal combustion engines, usually diesel engines.

Government regulations have recently required the use of devices to treat engine exhaust gas (hereinafter after-treatment devices or ATDs) to remove residual pollutants from the raw exhaust gas. These devices can be remotely mounted from the engine to treat the exhaust gas. The ATDs have a very high surface temperature when they undergo periodic regeneration. These high temperatures at the outer surface of the devices can cause dust or other plant matter that collects on the outer surface to combust.

One way of preventing this combustion is to keep the surface of the ATD clean. This can be achieved by directing a portion of the air moved by the radiator cooling fan across the upper surface of the ATD. An example of this arrangement can be seen in US 2010/0275587 A1.

A drawback to these and similar designs is that the air used for cleaning the surface of the ATD contains dust and other plant matter. The air directed across the surface of the ATD by these prior designs must scour the surface at a high velocity in order to prevent the dust mixed with the air from settling on the surface of the ATD and permitting a layer of dust to build up.

Furthermore, if the ATD is placed remotely from the engine, a rather long conduit must be provided to conduct air from the cooling air fan to the ATD.

What is needed is an arrangement for keeping the ATD clean of dust and other particulate matter using a source of clean air or gas that avoids the expense of using a conduit and that does not rob some of the power from the cooling fan.

It is an object of this invention to provide such an arrangement.

SUMMARY OF THE INVENTION

In accordance with a first aspect of the invention, an ATD has a shield that substantially encloses the outer surface of the ATD. This shield is coupled to the exhaust gas outlet of the ATD. At least a portion of the treated exhaust gas (i.e. the exhaust gas leaving the ATD) is conducted into the space between the outer surface of the ATD and the shield. Various structures (described in more detail below) conduct at least a portion of the treated exhaust gas into the space defined between the shield and the ATD at a higher pressure than the surrounding atmosphere and therefore slightly pressurizes the space. The slightly pressurized treated exhaust gas displaces the lower pressure ambient air that contains suspended dust and combustible particulates. The treated exhaust gas has almost no suspended combustible matter or dust since it has already been combusted in the internal combustion engine and has further passed through the ATD element. This arrangement prevents or significantly reduces the dust and combustible particulate matter entrained in the surrounding atmosphere from settling and accumulating on the outer surface of the ATD.

All the exhaust gas exiting the ATD can be communicated into the space between the shield and he ATD. Alternatively, only a portion of the gas may be communicated into the space, leaving the remainder (and preferably the majority) of the exhaust gas to continue out an exhaust pipe that is coupled to and extends from the exhaust gas outlet of the ATD.

A venturi or other structure may be located in an exhaust gas line extending from the outlet of the ATD to the space between the shield and the ATD to entrain air from the atmosphere surrounding the ATD. This arrangement preferably uses the kinetic energy of the exhaust gas to entrain atmospheric air with the exhaust gas diverted into the space. The outlet of this venturi or other structure may then be conducted through a conduit to the space between the shield and the ATD to thereby insert this exhaust and air mixture into the space between the shield and the ATD.

DETAILED DESCRIPTION OF THE INVENTION

In the discussion herein, "after-treatment device" refers to any device for chemically converting or processing exhaust gas from an internal combustion engine before the release of the exhaust gas into the atmosphere, including but not limited to diesel particulate filters and catalytic converters.

The term "pressure" or "pressurize" is used herein. The amount of pressure that is deemed to constitute being "pressurized" is an amount of pressure sufficient to prevent substantially all ambient air from entering and circulating freely within the shielding in quantities that permit combustible quantities of dust or particulate matter to settle on the after-treatment device.

Figure 1:
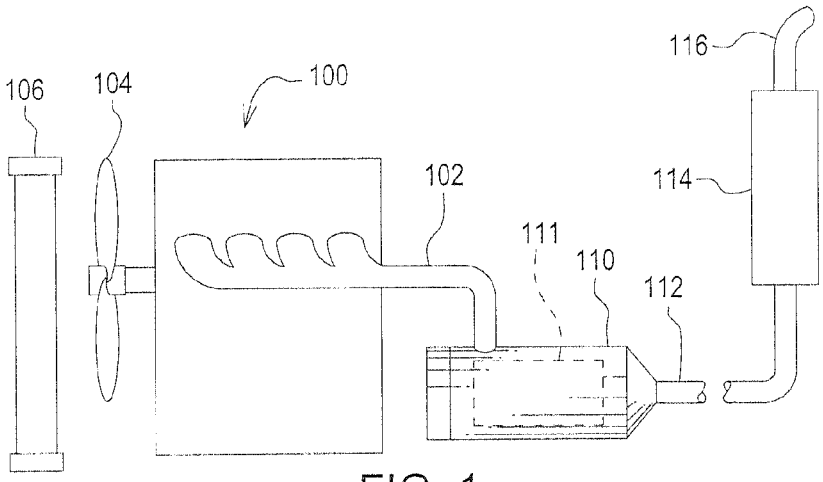
FIG. 1 (PRIOR ART)
FIG. 1 is a schematic diagram of a prior art arrangement of an internal combustion engine with an ATD and an exhaust stack or muffler.

Referring now to the drawings and more particularly to FIG. 1 there is shown an internal combustion engine 100 for a work vehicle such as an agricultural vehicle. The IC engine 100 has an exhaust manifold 102 that receives exhaust gas from the cylinders of the IC engine 100. A cooling fan 104 is provided to draw air through a radiator 106 that is in fluid communication with the IC engine 100.

The exhaust manifold 102 is coupled, as by an exhaust gas inlet conduit 108, to an inlet of an after-treatment device (ATD) 110, which is here shown as a catalytic converter or a diesel particulate filter.

The ATD has a generally cylindrical body containing an after-treatment element 111 (shown only in FIG. 1) and being provided with a treated exhaust gas outlet coupled to a treated exhaust gas outlet conduit 112. Outlet conduit 112 is in fluid communication with an exhaust stack or muffler 114 which carries the exhaust gas away from the vehicle and releases it into the atmosphere through outlet 116. This arrangement of an ATD with an engine and exhaust stack or muffler is the intended arrangement with which the novel ATD with shield of FIGS. 2-5 is intended to be used.

Figure 2:
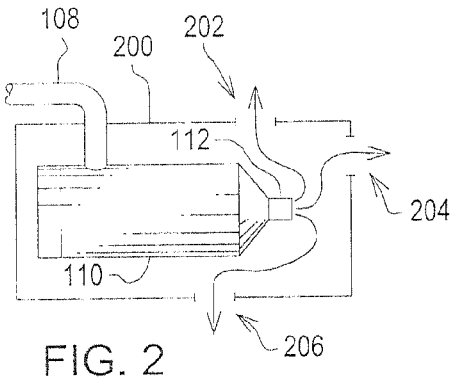
FIGS. 2-5 are schematic diagrams of the ATD shown in the arrangement of FIG. 1 in combination with respective airborne dust control arrangements constructed in accordance with the present invention.

FIG. 2 illustrates a first embodiment of the ATD 110 in accordance with the present invention. In this arrangement, the ATD 110 is enclosed with a shield 200 having an outer surface surrounded by atmospheric air and having an inner surface that extends completely around the ATD or extends at least an amount sufficient to cover the dust-collecting upper surfaces. The preferred embodiment is disclosed in FIG. 2 in which substantially the entire ATD 110 is surrounded by the shield 200, in which the shield 200 is formed exclusively of the inlet conduit 108 and outlet conduit 112, and in which the exhaust gas inlet conduit 108 passes through the shield 200.

The exhaust gas outlet conduit 112 empties into the space defined between the shield and the ATD 110 and exits through any one or more of top aperture 202, end aperture 204, and bottom aperture 206. The flow of exhaust gas into the space creates a pressure slightly above atmospheric pressure in the space and therefore prevents dust and particulate carrying atmospheric air at the outer surface of the shield 200 from directly entering the shield through any one or more of the apertures 202, 204, and 206 and depositing the dust and particulates on the outer surface of ATD 110.

In this arrangement, substantially all the exhaust is communicated into the space between the ATD and the shield. This is not necessary, however, as the next figure illustrates.

Figure 3:
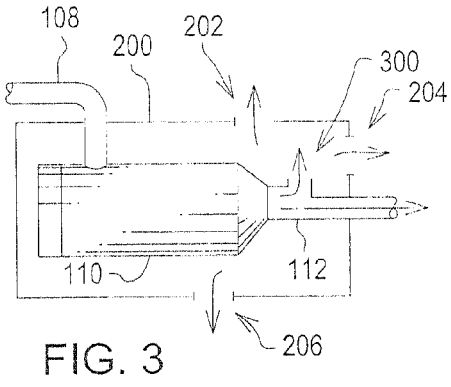

In the FIG. 3 embodiment of the invention the exhaust gas outlet conduit 112 extends through an end of the shield 200, but has an aperture 300 located inside the shield 200 that permits a portion of the treated exhaust gas to leave the exhaust gas outlet conduit 112 and be communicated into the space between the shield and the ATD. The remaining volume of treated exhaust gas is conducted through the exhaust gas outlet conduit 112, through the shield 200 and into the exhaust stack or muffler 114 (as shown in FIG. 1).

Figure 4:
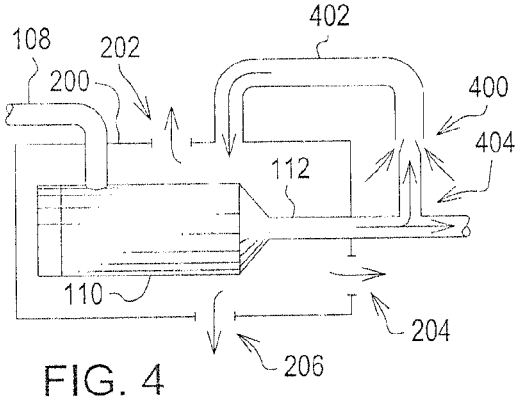

The third embodiment (FIG. 4) discloses an alternative method of communicating exhaust gas into the space between the shield and the ATD. In FIG. 4, the exhaust gas outlet conduit 112 splits its flow path as in the embodiment of FIG. 3, but in FIG. 4 the split occurs exteriorly of the shield 200 where an aperture in the conduit 112 directs a portion of the exhaust gas into an external conduit 404 that includes a venturi 400. The venturi 400 uses the flow of the exhaust gas to entrain a portion of atmospheric air and conducts the mixed exhaust gas and atmospheric air through a continuing portion 402 of conduit 404 back through the shield 200 and into the space between the shield and the ATD. This arrangement serves to provide a cooler source of gas to surround the ATD. By entraining a portion of the atmospheric air surrounding the ATD into the space there is some additional dust that is introduced. However, by carefully selecting the relative size of the venturi this additional dust can be maintained below a critical level while still providing the benefits of keeping the ATD clean.

Figure 5:
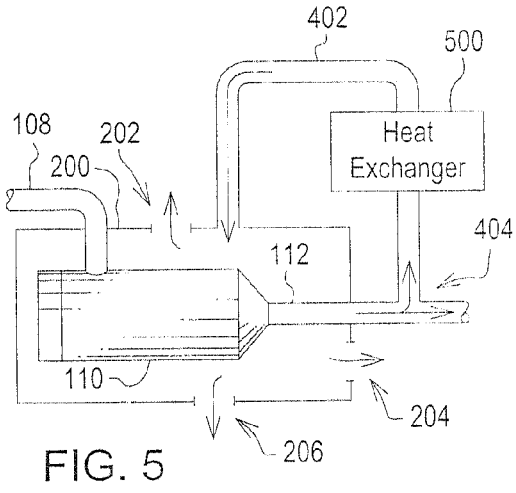

In an alternative arrangement (not shown), a conduit without the venturi can be employed to conduct at least a portion of the treated exhaust gas to a location on the outside of the shield and the space, and then to conduct it back through the shield and into the space as shown in FIGS. 4-5 but without the venturi or the heat exchanger.

The fourth embodiment (FIG. 5) shows the same arrangement of FIG. 4, but with the venturi 400 removed and replaced with a heat exchanger 500 that is configured to cool down the exhaust gas introduced into conduit 404.

Having described the preferred embodiment, it will become apparent that various modifications can be made without departing from the scope of the invention as defined in the accompanying claims.

The invention claimed is:

1. An exhaust gas after-treatment device in combination with an airborne dust control arrangement, comprising:

said after-treatment device including a body having an outer surface, an exhaust gas inlet formed in the body, an exhaust gas inlet conduit coupled directly to said inlet, and an exhaust gas outlet formed in the body, an exhaust gas outlet conduit coupled directly to said outlet, the after-treatment device further including an after-treatment element contained in said body between said exhaust gas inlet and said exhaust gas outlet for treating the exhaust gas to reduce products of incomplete combustion and through which the exhaust gas passes as the exhaust gas travels from the exhaust gas inlet through said after-treatment element and to the exhaust gas outlet;

said dust control arrangement including a shield formed exclusive of said inlet conduit and said outlet conduit and comprising an inner surface and an outer surface, with the outer surface being surrounded by atmospheric air, the shield extending around at least an upper portion of the outer surface of the body of the after-treatment device and defining a space including at least an upper portion between the at least upper portion of the outer surface of the body and the inner surface of the shield, with the space being exposed directly to the atmospheric air surrounding the shield; and a means for pressurizing the space by communicating at least a portion of the exhaust gas exiting the exhaust gas outlet with the space so as to exclude the atmospheric air surrounding the shield from the space.

2. The exhaust gas after-treatment device of claim 1, wherein the shield and space substantially surround the entire body of the after-treatment device, with the shield being provided with at least one aperture directly exposing the space to the atmospheric air surrounding the shield, and wherein the means for pressurizing the space includes an outlet conduit formed exclusive of said shield and coupled directly to the outlet of said body and terminating within said space.

3. The exhaust gas after-treatment device of claim 1 wherein the shield and space substantially surround the body of the after-treatment device, with the shield being provided with at least one aperture exposing the space directly to the atmospheric air, and the means for pressurizing the space includes an outlet conduit formed exclusive of said shield and coupled directly to the outlet of said body and extending through said shield, said outlet conduit including an aperture located within said space, whereby first and second portions of the exhaust gas exiting from the outlet are respectively communicated into the space by the aperture in the outlet conduit and into an exhaust stack by the outlet conduit extending through the shield beyond the aperture in the outlet conduit, and the aperture in the outlet conduit being sized such that the first portion of the exhaust gas exiting from the exhaust gas outlet into the space via the aperture in the exhaust gas outlet conduit is smaller than the second portion of the exhaust gas which is communicated by the outlet conduit into the exhaust stack.

4. The exhaust gas after-treatment device of claim 2, wherein the at least one aperture is located in an upper portion of the shield.

5. The exhaust gas after-treatment device of claim 2, wherein the at least one aperture is located in a generally horizontal facing surface of the shield.

6. The exhaust gas after-treatment device of claim 2, wherein the at least one aperture is located in a downwardly facing surface of the shield.

7. The exhaust gas after-treatment device of claim 1, wherein the shield substantially surrounds the body of the after-treatment device and is provided with at least one aperture directly exposing the space to the atmospheric air surrounding the shield, and the means for pressurizing includes a first means for communicating all of the exhaust gas to a location outside of the shield and includes a further means for communicating at least a portion of the exhaust gas from the location outside of the shield back through the shield and into the space.

8. The exhaust gas after-treatment device of claim 7 wherein the further means for communicating at least a portion of the exhaust gas back through the shield and into the space comprises a continuing conduit located entirely outside said shield and having an end coupled to said shield for delivering a mixture of atmospheric air and exhaust gas to said space, and an external conduit having a first end coupled to said exhaust gas outlet conduit at a location outside said shield and a second end located for delivering a stream of exhaust gas having kinetic energy into said continuing conduit, with an interior of said continuing conduit being exposed to the atmospheric air surrounding the shield such that the kinetic energy of the at least a portion of the exhaust gas acts for entraining the atmospheric air into the continuing conduit, whereby the mixture of atmospheric air and exhaust gas is delivered to said space.

9. The exhaust gas after-treatment device of claim 8, wherein the external conduit and continuing conduit cooperate to define a venturi that uses the kinetic energy of the at least a portion of the exhaust gas to draw the atmospheric air into the continuing conduit.

10. The exhaust gas after-treatment device of claim 7, wherein the further means for communicating at least a portion of the exhaust gas back through the shield comprises a heat exchanger connected for receiving, and conducting heat from, the at least a portion of the exhaust gas before said at least a portion of the exhaust gas is released into the space.

11. An exhaust gas after-treatment device in combination with an airborne dust control arrangement, comprising:

a body of the after-treatment device having a closed exterior coupled to directly to an exhaust gas inlet conduit and directly to an exhaust gas outlet conduit;

an after-treatment element located within said body;

a shield of said dust control arrangement substantially surrounding said body and defining a space between the shield and the body, with said shield containing at least one aperture exclusive of said exhaust gas outlet and directly exposing said space to atmospheric air; and said exhaust gas outlet conduit being coupled to said space for pressurizing said space above atmospheric pressure with treated exhaust gas so as to exclude atmospheric air, and hence airborne dust, from said space.

* * * * *